US005708226A

United States Patent [19]

Nagahara

[11] Patent Number: 5,708,226

[45] Date of Patent: Jan. 13, 1998

[54] THUMB KEY FOR FLUTES AND PICCOLOS

[76] Inventor: Kanichi Nagahara, 32 Wild Rose Dr., Andover, Mass. 01810

[21] Appl. No.: 696,236

[22] Filed: Aug. 13, 1996

[51] Int. Cl.[6] ..... G10D 9/04

[52] U.S. Cl. ..... 84/384; 84/380 R

[58] Field of Search ..... 84/384, 380 R, 84/382, 385 R, 386

[56] References Cited

U.S. PATENT DOCUMENTS 4,376,403 3/1983 Haedrich et al. ..... 84/384

*Primary Examiner*—Cassandra C. Spyrou

*Attorney, Agent, or Firm*—Scott B. Garrison; Gary E. Lambert

[57] ABSTRACT

An improved design for the thumb key assembly for flutes and piccolos. This design allows for longer tubing to be used in the assembly without requiring a larger space, resulting in a mechanism that is less prone to wear. The design also locates the thumb key and thumb lever further away from the "A" kicker tail, allowing for a more stable, standard sized kicker to be used. Additionally, the design also reduces the likelihood that a player will inadvertently depress the thumb lever when intending only to depress the thumb key. Finally, this design also provides a common configuration which can be adapted to both flutes and piccolos with the only change necessary being one of size.

10 Claims, 3 Drawing Sheets

THUMB KEY FOR FLUTES AND PICCOLOS

BACKGROUND OF THE INVENTION

The present invention relates to the field of musical instruments. More particularly, it relates to an improved thumb key for flutes and piccolos. The traditional or conventional flute thumb key assembly is a notorious trouble spot for many players. A slight maladjustment or misalignment of the key can adversely affect the entire instrument. Piccolos are even more troublesome due to their small size. Because of a piccolo's small size, a traditional flute-style thumb key cannot be used. As a result the conventional piccolo thumb key assembly is a mechanically inefficient compromise.

The traditional flute thumb key assembly consists of a steel shaft suspended between two thumb posts. Slid onto the shaft by short lengths of tubing are the B-natural thumb key and the B-flat thumb lever. Both the key and the lever pivot freely about the shaft. The shaft is attached and arranged at a right angle to the longitudinal axis of the instrument, i.e., at a tangent to the circumference of the instrument. This poses problems not associated with the other keys or levers on the flute because, the thumb key assembly is the only key or lever attached perpendicular to the flute's long axis.

One such problem is a direct result of the typical flute being slightly less than one inch in diameter. Therefore this configuration does not provide a large surface upon which to mount the thumb posts for receipt of the shaft. Consequently the space available for the thumb key assembly is limited. Because the thumb key assembly consists of the B-natural thumb key and the B-flat thumb lever both must share the space. The traditional configuration of mounting the key and lever to the instrument is to slide both the key and lever onto the shaft so that they lie adjacent and in side-to-side contact, one with respect to the other. Unfortunately for proper operation of the instrument, neither the key nor the lever can be pinned to the shaft because they must pivot about the shaft. This arrangement results in a reduced bearing surface between each of the key and levees respective tubing and the shaft. Such an arrangement leads to excessive wear on the key and lever due to the thumb key assembly design and the natural action of the human hand. Typically a player's hand places lateral force against the pivotal axis of the thumb key assembly, this force wears the surface between the tubing and shaft. These in turn become loose and go out of alignment with the tone hole thereby affecting the quality of play. Such wear between the shaft and the tubing is only exasperated through time until it affects the instrument by causing improper seating of the B-flat thumb cup with respect to the tone hole. At some point this wear negatively impacts the quality of the other notes on the instrument.

Another problem caused by the current configuration is that placement of the thumb lever and thumb key arms result in reduced clearance between the thumb lever and kicker tail of the "A" key. This shorter kicker tail places the fulcrum about which the "A" key pivots off-center, making precise adjustment difficult.

These problems are only aggravated on piccolos. The smaller diameter of the piccolo cannot accommodate a thumb key assembly based upon the traditional time design. As a result, the traditional piccolo thumb key rotates on an axis parallel to the piccolo itself. This arrangement complicates a player's transition between flutes and piccolos, and such transition occurs regularly within the musical industry. Additionally, the fulcrum or pivot point of the piccolo thumb key assembly lies in close proximity to the tone hole. As such, the thumb key assembly must open more than the equivalent flute thumb key assembly in order to ensure proper ventilation of the tone hole. This requirement that the piccolo thumb key assembly open wider results in a slower action on the instrument.

SUMMARY OF THE INVENTION

What is needed is a better thumb key assembly which reduces or eliminates the deficiencies found in the existing embodiment as discussed above. The inventor has developed such a thumb key assembly. This new thumb key assembly improves upon the traditional flute thumb key assembly design, and enables the same type of thumb key assembly to be used on piccolos.

The essence of the invention is to increase the effective length of both thumb key and thumb lever tubing without requiring a larger space to accommodate the assembly. The key to accomplishing this was to find a solution not previously considered within the industry. The resolution of the problem was to increase the diameter of the thumb key and lever tubing, allowing the insertion of a sleeve inside the tubing, said sleeve being allowed to rotate freely on the shaft. The sleeve in the present invention is fixed to the thumb key tubing and now envelops the entire length of the shaft exposed between the thumb posts, thereby providing the maximum beating surface between the inner circumferential surface of the sleeve and the outer circumferential surface of the shaft. Creating a bearing surface of this length enables the thumb key assembly to better tolerate any lateral force placed on the key by a player. The thumb lever tubing, in turn, having the same increased diameter as the thumb key tubing, can now pivot about the sleeve rather than the shaft. This arrangement allows greater leeway in choosing the maximum effective length for the key and lever tubing. Because the sleeve runs the entire length of the shaft, the thumb key tubing can be made shorter, making room in turn for a longer thumb lever tubing. Also, by shaping the lever along its length to have a bend, crook, or gooseneck which allows it to be placed slightly beneath the fingered area or spatula of the thumb key, it has been found that the key and lever can be brought even closer together, again allowing for a longer lever tubing. This "overlapping" of the thumb lever by the thumb key also reduces the likelihood that a player will accidentally depress the thumb lever while depressing the thumb key. This arrangement also allows the assembly as a whole to be moved away from the "A" kicker tail. This enables the use of a standard-size kicker tail for the "A" key.

It is therefore an object of the present invention to provide an improved thumb key assembly for use on instruments, particularly flutes and piccolos.

It is a further object of the present invention to provide an improved thumb key assembly which reduces or eliminates the wear typically found on the thumb key and thumb lever as a result of lateral stresses placed upon their respective pivot points by a player.

It is a further object of the present invention to provide an improved thumb key assembly which enables a manufacturer of flutes to use standard size kicker tails rather than being forced to use a shorter kicker tail in at a minimum one location.

It is still a further object of the present invention to provide an improved thumb key assembly which except for a difference in size can be used on both flutes and piccolos.

It is another object of the present invention to provide an improved thumb key assembly which because of a change in the key configuration reduces the likelihood of a player inadvertently depressing the lever when said player only intended on depressing the key.

BRIEF DESCRIPTION OF THE DRAWINGS

The novel features considered characteristic of the invention are set forth in the appended claims. The invention itself, however, both as to its construction and its method of operation, together with additional objects and advantages thereof, will best be understood from the following description of the specific embodiments when read and understood in connection with the accompanying drawings.

FIG. 1 is a plan view looking down upon a thumb key assembly of the present invention shown in place upon its typical location in this case on a flute but on a piccolo the arrangement would be similar;

DETAILED DESCRIPTION OF THE PREFERRED EMBODIMENT

Figure 1:
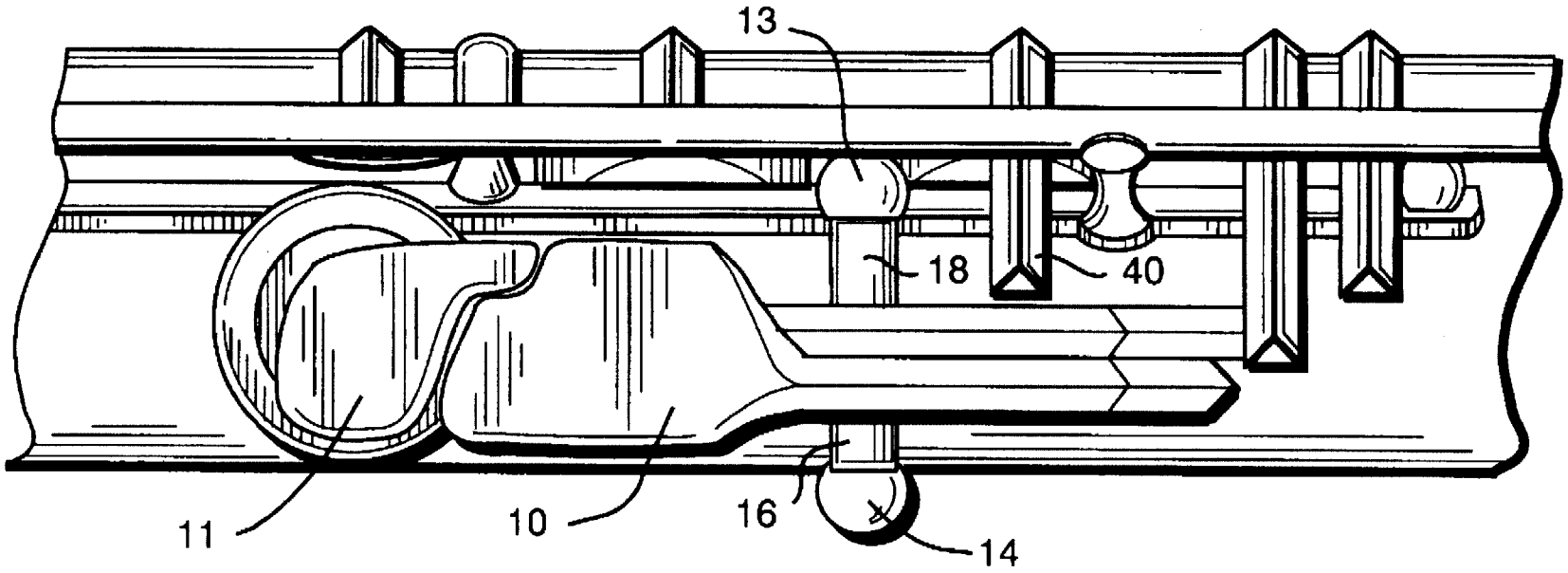

FIG. 1 depicts the preferred embodiment of a new thumb key assembly in accordance with the present invention shown in place at its intended location on a flute. A piccolo would look and have a similar arrangement. 1 refers generally to an instrument, in this case a flute however as stated, a piccolo would also be applicable. Upon flute 1 a new thumb key assembly is mounted said assembly comprises thumb key 10 and thumb lever 11, in this case, the B-natural thumb key for the former and the B-flat thumb lever for the latter. Both key 10 and lever 11 ultimately pivot about shaft 12 (depicted in FIG. 2). Shaft 12 is affixed between two thumb posts 13 and 14. Neither the shaft nor the thumb posts have been impacted by the new thumb key assembly design and therefore do not form a part of the invention in any respect other than to establish the location upon which said thumb key assembly is mounted.

Figure 2:
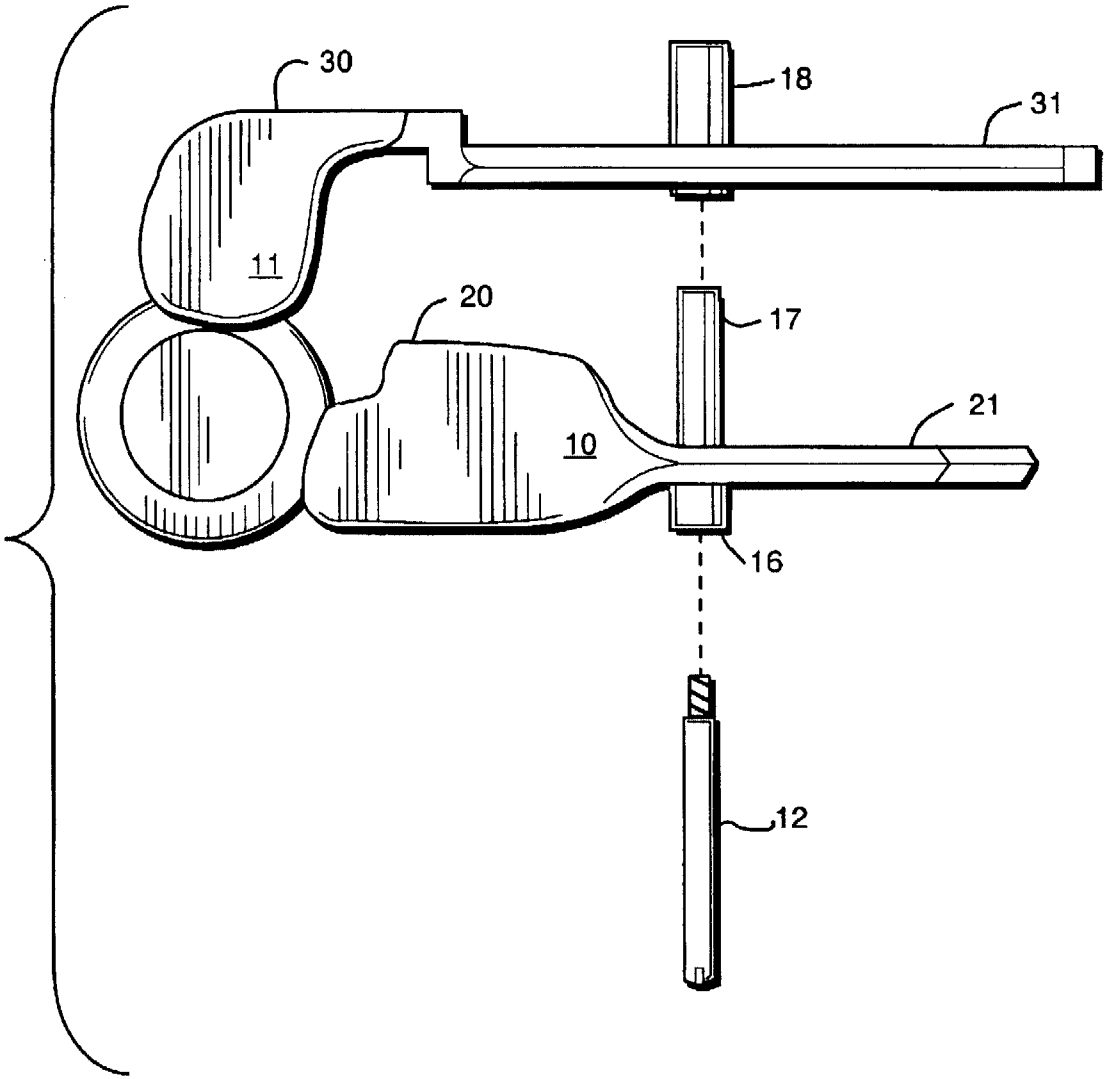
FIG. 2 is an exploded plan view of the thumb key assembly depicting the interrelationship of the parts and their assembly.

FIG. 2 provides a more detailed view of the configuration of the thumb key assembly. As can be seen, key 10 comprises a spatula 20 and arm 21. At a point disposed between spatula 20 and the end-most point of arm 21 is tubing 16. Lever 11 also comprises a spatula 30 and an arm 31. Tubing 18 is disposed between spatula 30 and the end-most point of arm 31. Sleeve 17 is used to rotatingly connect tubing 16 to tubing 18, thereby effectively rotatingly linking key 10 to lever 11. Assembly of the thumb key assembly is accomplished by first fixably engaging sleeve 17 with tubing 16 by sliding sleeve 17 into tubing 16 and securing with an affixing means, some such means contemplated being solder, brazing, or a press fit. Lever 11 is then slidingly engaged with sleeve 17 via tubing 18, and allowed to rotate about sleeve 17. Key 10 and lever 11, now rotatingly linked as a unit, are engaged to shaft 12 by slidingly engaging shaft 12 through sleeve 17. The internal diameter surface of tubing 18 acts as a bearing with respect to the external diameter surface of sleeve 17. The internal diameter surface of sleeve 17 acts as a bearing with respect to the external diameter surface of shaft 12. Once key 10 and lever 11 have been engaged with shaft 12, shaft 12 is held onto flute 1 in the conventional manner. The manner in which the thumb key assembly functions is as follows. Sleeve 17 pivots about shaft 12 at its fulcrum point located at shaft 12. This pivotal action is the same action taking place in traditional flute design. However, unlike in a conventional flute, tubing 18 rocks or pivots about the external surface of sleeve 17 rather than shaft 12. Spatulas 20 and 30 have also been configured differently than in the conventional flute. The purpose of reconfiguring both spatulas is twofold. First to reduce the possibility of the player accidentally depressing the B-flat thumb lever while intending to depress only the B-natural thumb key, and second, to enable the thumb lever to be moved further from the "A" key. FIG. 1 depicts the preferred arrangement of key 10 and lever 11. In the preferred embodiment of the present invention, tubing 16 can be considerably shortened, although due to its attachment to sleeve 17, its effective length with regard to bearing surface runs the entire distance between thumb posts 13 and 14. Reducing the length of tubing 16 from the conventional configuration, enables placement of key 10 and thus ultimately lever 11 to be further away from kicker tail 40 while also providing a configuration that allows the use of longer tubing 18 for the thumb lever. The actual length of tubing 16 is not crucial, but one preferred embodiment reveals that tubing 16 should encompass about one-quarter of the length of sleeve 17, whereas tubing 18 encompasses the remainder of sleeve 17.

Figure 3:
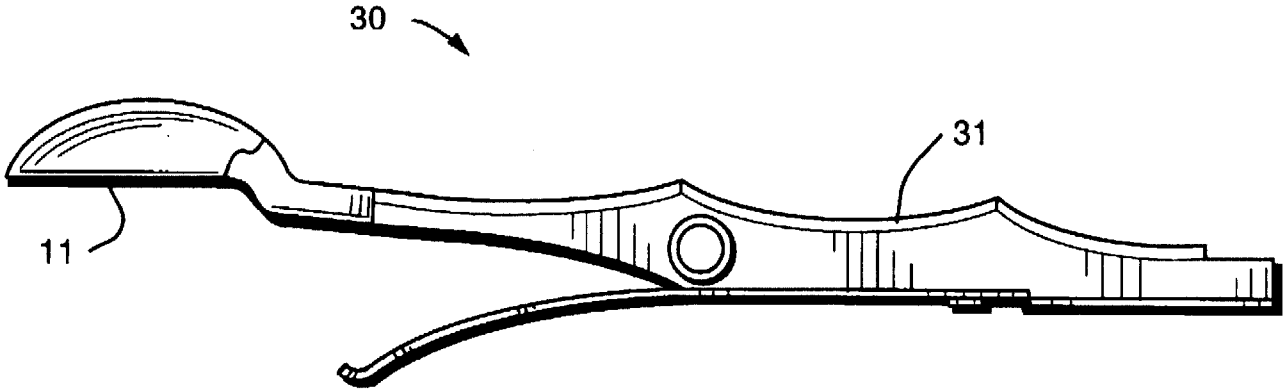
FIG. 3 is a side elevation view of the thumb lever.
Figure 4:
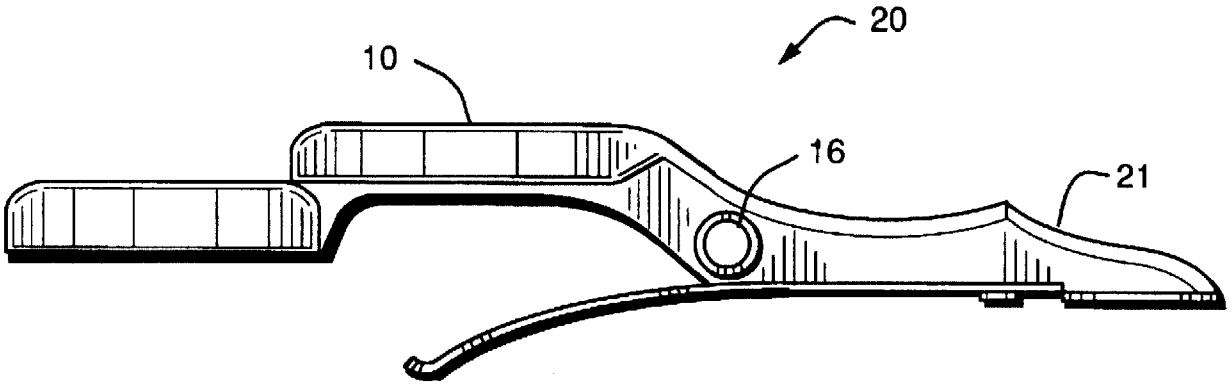
FIG. 4 is a side elevation view of the thumb key.

By placing a bend or gooseneck in arm 31 as depicted in FIG. 3, arm 31 can be disposed between flute 1 and beneath a section of spatula 20. In essence, spatula 20 extends towards and actually overlaps a portion of arm 31. This configuration places arm 31 in closer proximity to arm 21, and both are a greater radial distance offset from the longitudinal centerline of flute 1 than is possible in the conventional configuration. An additional reason to provide a larger spatula 20 is that it is less likely that a player will inadvertently depress lever 11 due to the increased size of spatula 20. This is especially critical for those players possessing large hands.

This preferred embodiment provides additional advantages to the flute or piccolo player in that the beating surface formed between tubing 16 (via sleeve 17) and shaft 12 is greater. As a matter of fact, the bearing surface comprises the entire length of shaft 12. This is because any lateral pivoting of key 10 on shaft 12 is compensated for by the additional bearing surface formed between sleeve 17 and shaft 12. Another advantage of this arrangement is a longer kicker tail 40 may be used, allowing for more precise adjustment of the "A" key than would otherwise be possible.

Although by no means necessary to the operation, the outside diameters of tubing 16 and tubing 18 could be made equal in order to improve the aesthetics of the instrument. Additionally, though it is not the preferred embodiment, tubing 16 could comprise a single unit having two different outside diameters, a first corresponding to sleeve 17 and a second corresponding to tubing 16. Other configurations are possible as well, one such alternative configuration being that sleeve 17 is secured to tubing 18, and tubing 16 is slid thereon.

While the invention has been described and illustrated with reference to a specific embodiment thereof, it is understood that other embodiments may be resorted to without departing from the invention. It is also reiterated that the above described preferred embodiment is also applicable to piccolos. Therefore the form of the invention set out above should be considered illustrative and not as limiting the scope of the following claims.

I claim:

1. An improved thumb key assembly for flutes and piccolos wherein said improvement comprises:

a thumb key, said thumb key further comprising an arm portion, a spatula portion and a fulcrum portion disposed therebetween, wherein said fulcrum portion comprises a short length of tubing integrally connected in perpendicular relation to said arm portion's longitudinal axis thereof, said tubing having an internal diameter;

a thumb lever, said thumb lever further comprising an arm portion, a spatula portion and a fulcrum portion disposed therebetween, wherein said fulcrum portion comprises a short length of tubing integrally connected in perpendicular relation to said arm portion's longitudinal axis thereof, said tubing having an internal diameter, and a sleeve, said sleeve having an internal and an external diameter, said external diameter capable of slidingly engaging in stacked relation said thumb key tubing and said thumb lever tubing through said internal diameters of said thumb key and said thumb lever.

2. An improved thumb key assembly in accordance with claim 1 wherein at least one of said thumb lever tubing and said thumb key tubing rotatingly contacts at said sleeve.

3. An improved thumb key assembly in accordance with claim 2 wherein said thumb key is affixed to said sleeve by an affixing means.

4. An improved thumb key assembly in accordance with claim 3 wherein said affixing means is selected from the group consisting of soldering, brazing, welding, and press fitting.

5. An improved thumb key assembly in accordance with claim 4 wherein said spatula portion of said thumb key extends laterally over said arm portion of said thumb lever.

6. An improved thumb key assembly in accordance with claim 5 wherein said thumb key tubing comprises about one-quarter of the total length of said sleeve and said thumb lever tubing.

7. An improved thumb key assembly in accordance with claim 1 wherein said thumb key tubing comprises about one-quarter of the total length of said sleeve and said thumb lever tubing comprises about three-quarters of the total length of said sleeve.

8. An improved thumb key assembly in accordance with claim 7 wherein said spatula portion of said thumb key extends laterally over said arm portion of said thumb lever.

9. An improved thumb key assembly in accordance with claim 8 wherein said thumb key tubing is permanently affixed to said sleeve, and said thumb lever tubing rotatingly contacts said sleeve.

10. An improved thumb key assembly in accordance with claim 9 wherein said thumb key assembly is further engaged with a shaft having an outside diameter, said outside diameter of said shaft internally engages said inside diameter of said sleeve and allows said sleeve to rotate upon said shaft.

* * * * *